US005765677A

United States Patent [19]

Ghini et al.

[11] Patent Number: 5,765,677

[45] Date of Patent: Jun. 16, 1998

[54] PRODUCT CONVEYING WHEEL

[75] Inventors: Marco Ghini, S. Lazzaro di Savena; Fiorenzo Draghetti, Medicina, both of Italy

[73] Assignee: G.D Societa' Per Azioni, Bologna, Italy

[21] Appl. No.: 791,829

[22] Filed: Jan. 30, 1997

[30] Foreign Application Priority Data

Jan. 31, 1996 [IT] Italy ..... BO96A0040

[51] Int. Cl.[6] ..... B65G 25/00

[52] U.S. Cl. ..... 198/803.9; 198/470.1; 131/94

[58] Field of Search ..... 131/94; 198/470.1, 198/803.9, 482.1, 803.7

[56] References Cited

U.S. PATENT DOCUMENTS 4,936,440 6/1990 Focke et al. ..... 198/427
5,607,045 3/1997 Kronseder ..... 198/476.4
5,657,855 8/1997 Ferguson ..... 198/803.7

FOREIGN PATENT DOCUMENTS 0317805 11/1988 European Pat. Off. ..... 198/803.9
1088106 3/1955 France ..... 198/803.9
3612811 11/1986 Germany ..... 198/803.9

*Primary Examiner*—Aaron J. Lewis
*Assistant Examiner*—Charles W. Anderson
*Attorney, Agent, or Firm*—Ladas & Parry

[57] ABSTRACT

A wheel for conveying products, in particular packets of cigarettes, is mounted for rotation about an axis, and presents at least one manipulating unit, the outer casing of which is fitted with a pocket for a packet and with a number of manipulating elements, and houses a control shaft presenting cams for controlling the manipulating elements; the casing is fitted releasably to a frame of the wheel; and the control shaft is connected to a countershaft by a face joint.

6 Claims, 2 Drawing Sheets

PRODUCT CONVEYING WHEEL

BACKGROUND OF THE INVENTION

The present invention relates to a product conveying wheel.

The present invention is especially suitable for use in the tobacco industry for manipulating, and more specifically wrapping, packets of cigarettes, to which specific reference is made in the following description purely by way of example.

Machines for wrapping packets of cigarettes are known to feature a succession of conveying wheels, each of which performs a given number of operations on each packet of cigarettes as this is fed by the wheel along a given path. For which purpose, known wheels comprise a number of peripheral manipulating units, each of which in turn comprises a seat for receiving a packet of cigarettes at a loading station, and at least one manipulating element for performing, under the control of a fixed central cam common to all the manipulating units, one or more operations on the packet housed inside the seat, and before the packet is unloaded off the wheel at an unloading station.

Known wrapping machines of the above type present several drawbacks in the event of a change in format, in which case, the wheels must be almost completely dismantled to change the central cams and the seats and respective manipulating elements.

SUMMARY OF THE INVENTION

It is an object of the present invention to provide a conveying wheel designed to overcome the aforementioned drawbacks by enabling a rapid and hence low-cost change in format.

According to the present invention, there is provided a product conveying wheel comprising a frame; at least one manipulating unit fitted to said frame and in turn comprising at least one movable manipulating element; and control means for controlling said manipulating element; characterized in that said control means comprise, for each said unit, a rotary control shaft, and at least one cam fitted to the control shaft and connected to the manipulating element; each unit comprising a casing housing the respective control shaft and supporting the manipulating element; first removable connecting means being provided for removably connecting said casing to said frame; an operating shaft being fitted to said frame and rotating about its own axis in relation to the frame; and second removable connecting means being provided for angularly connecting the operating and control shafts.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
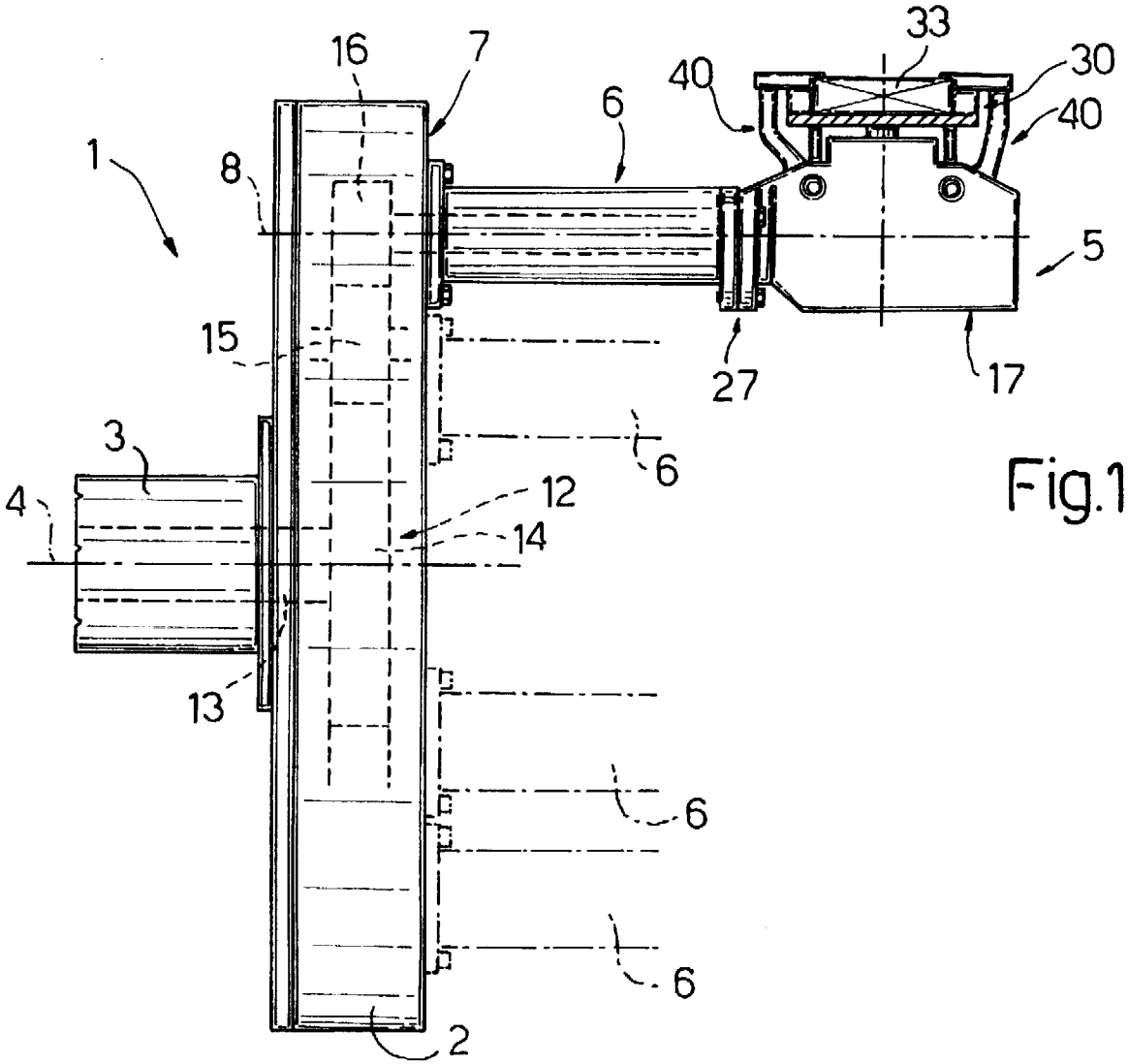
FIG. 1 shows a schematic side view of a preferred embodiment of the conveying wheel according to the present invention.

Number 1 in FIG. 1 indicates a conveying wheel for continuous wrapping machines for wrapping packets of cigarettes. Wheel 1 comprises a cylindrical platform or box frame 2 fitted to one end of a tubular drive shaft 3, which is rotated about its axis 4 by a known actuating device (not shown).

In addition to frame 2, wheel 1 also comprises a number of manipulating units 5 equally spaced about the periphery of frame 2 and each fitted to a respective tubular body 6, which is connected rigidly to frame 2, extends from a front surface 7 of frame 2 coaxially with its own axis 8 parallel to axis 4, and presents a through hole 9 coaxial with axis 8.

According to a variation not shown, body 6 is connected to frame 2 so as to rotate in a given manner in relation to frame 2 and about its own axis 8 by virtue of a known actuating device.

Figure 2:
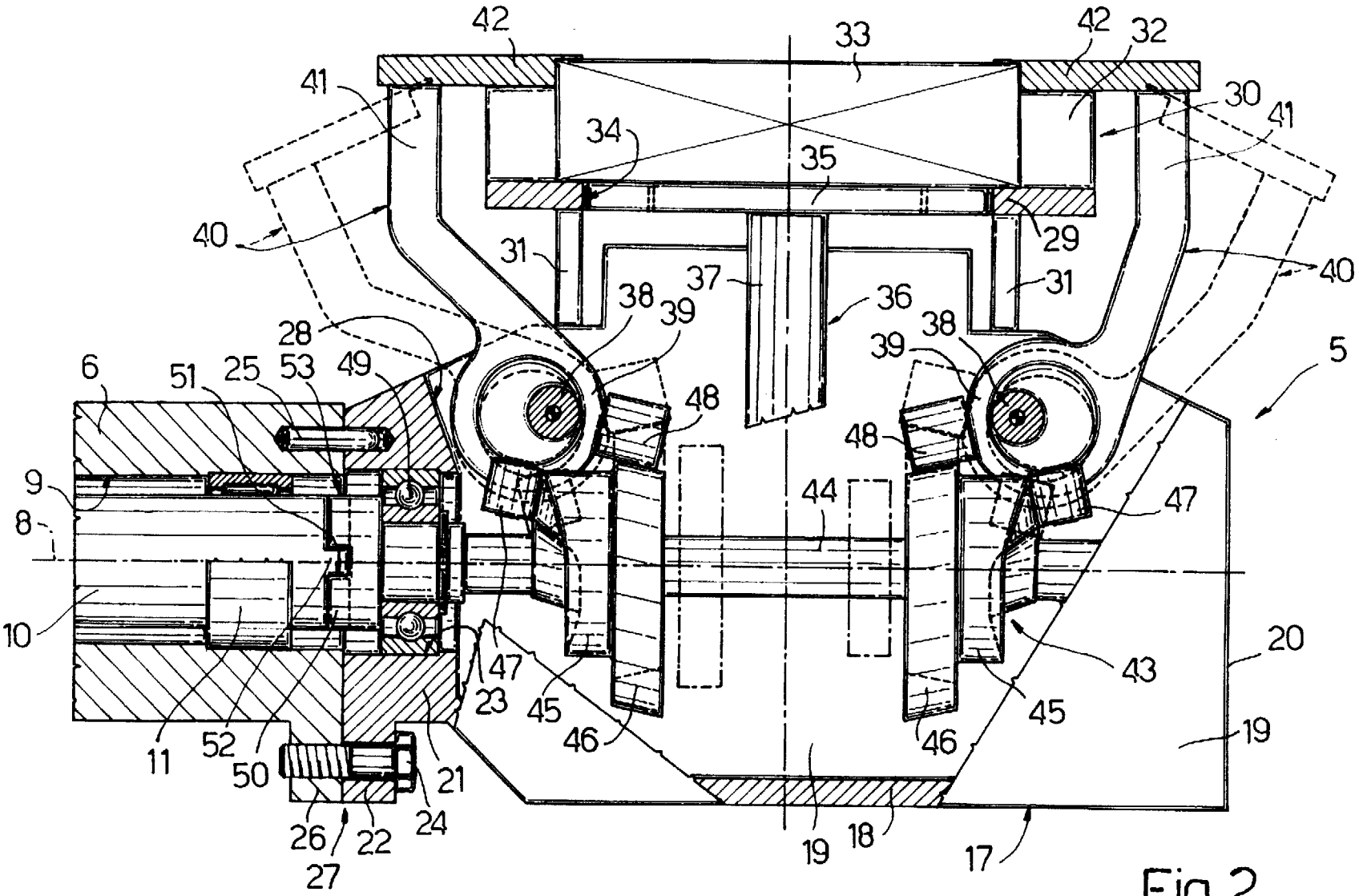
FIG. 2 shows a larger-scale view, with parts in section and parts removed for clarity, of a detail of the FIG. 1 conveying wheel.

With reference to FIG. 2, each body 6 houses a transmission shaft 10 coaxial with respective axis 8 and mounted for rotation on respective bearings 11 (only one shown) interposed between shaft 10 and the surface of hole 9. Shafts 10 (only one shown) are activated by an epicyclic gear train 12 housed inside frame 2 and comprising a normally fixed shaft 13 coaxial with axis 4 and extending along shaft 3; a sun gear 14 fitted to shaft 13 and housed inside frame 2; a number of intermediate gears 15 housed inside and fitted to frame 2 so as to mesh with sun gear 14 and rotate about respective axes parallel to axis 4; and, for each gear 15, a planetary gear 16 meshing with respective gear 15 and fitted to a respective shaft 10.

As shown in FIG. 2, each unit 5 comprises a cup-shaped casing 17 in turn comprising a bottom wall 18 parallel to respective axis 8, two lateral walls 19 also parallel to axis 8, a first end wall 20 perpendicular to axis 8, and a second end wall opposite wall 20, perpendicular to axis 8, and defined by a bush 21 presenting an outer flange 22 and a central hole 23 coaxial with axis 8. By means of screws 24 and centering pins 25, flange 22 is connected to an end flange 26 of respective body 6, and defines, with respective flange 26 and respective screws 24 and pins 25, a face joint 27 for removably connecting respective unit 5 to respective body 6.

On the opposite side to that connected to wall 18, walls 19 define an opening 28 facing the bottom wall 29 of a pocket 30 fitted to walls 19 via the interposition of two brackets 31. Wall 29 is parallel to wall 18, and is connected to two lateral walls 32 extending outwards parallel to walls 19 and defining, with wall 29, a substantially U-shaped seat for a respective packet 33. Wall 29 presents a central through opening 34 through which is fitted movably the end plate 35 of a pusher 36, the shaft 37 of which is movable axially by a known actuating device (not shown) to move plate 35 through pocket 30 to accompany packet 33 into and/or expel packet 33 from pocket 30.

Two shafts 38 are fitted in rotary manner between and perpendicularly to walls 19 and symmetrically in relation to shaft 37; each shaft 38 presents an eccentric intermediate plate fitted with an end bush 39 of a manipulating element 40; and each manipulating element 40 comprises a lever 41 extending substantially radially from bush 39 and through opening 28, and a manipulating arm 42 extending towards pocket 30 from the free end of lever 41, and which, when shaft 38 is rotated, is moved between an idle position (shown by the dotted line in FIG. 2) in which arm 42 is located outwards of pocket 30, and an operating position in which arm 42 engages packet 33 to perform a given operation thereon.

The angular position of shafts 38, and hence the position of manipulating elements 40, is controlled by a control device 43 forming part of unit 5 and comprising a control shaft 44 coaxial with axis 8, and, for each manipulating element 40, a face cam 45 and a drum cam 46, both fitted to shaft 44 and cooperating with respective tappet rollers 47 and 48 fitted in rotary manner to respective bush 39.

Shaft 44 is fitted in rotary manner to casing 17 via the interposition of bearings (only one shown), one of which, indicated 49, is fitted inside bush 21. At the end beyond bearing 49 towards respective body 6, shaft 44 is fitted with a plate 50 projecting outwards of casing 17 and presenting a diametrical groove 51, which is engaged by a diametrical rib 52 formed on the end surface of respective shaft 10 and defining, with grooved plate 50, a face joint 53 for angularly connecting shafts 10 and 44.

Operation of wheel 1 is clearly understandable from the foregoing description, and therefore requires no further explanation.

It should be pointed out, however, that, by virtue of each unit 5 of wheel 1 presenting its own cams 45, 46, as opposed to a centralized control cam, a change in format may be effected by simply removing screws 24 to detach units 5, and assembling other units 5 suitable for the new format.

We claim:

1. A product conveying wheel, the wheel (1) comprising a frame (2); at least one manipulating unit (5) fitted to said frame (2) and in turn comprising at least one movable manipulating element (40); and control means (43) for controlling said manipulating element (40); characterized in that said control means (43) comprise, for each said unit (5), a rotary control shaft (44), and at least one cam (45, 46) fitted to the control shaft (44) and connected to the manipulating element (40); each unit (5) comprising a casing (17) housing the respective control shaft (44) and supporting the manipulating element (40); first removable connecting means (27) being provided for removably connecting said casing (17) to said frame (2); an operating shaft (10) being fitted to said frame (2) and rotating about its own axis (8) in relation to the frame (2); and second removable connecting means (53) being provided for angularly connecting the operating (10) and control (44) shafts.

2. A wheel as claimed in claim 1, characterized in that said first removable connecting means (27) comprise a flanged face joint (27).

3. A wheel as claimed in claim 2, characterized by comprising a tubular body (6) for supporting said casing (17); the tubular body (6) being connected to said frame (2) and being fitted through with said operating shaft (10); and said flanged face joint (27) being interposed between said casing (17) and a free end of the tubular body (6).

4. A wheel as claimed in claim 3, characterized in that said tubular body (6) presents an axis coincident with the axis (8) of said operating shaft (10), coaxial with said control shaft (44), and parallel to an axis (4) of rotation of the wheel (1).

5. A wheel as claimed in claim 1, characterized in that said second removable connecting means (53) comprise a face joint interposed between one end of the operating shaft (10) and one end of the control shaft (44).

6. A wheel as claimed in claim 5, characterized in that said face joint (53) comprises a diametrically-grooved plate (50) fitted to one of said two operating (10) and control (44) shafts, and a diametrical rib (52) on a free end of the other of said two shafts (10, 44).

* * * * *